US005403104A

United States Patent [19]

Cappellina

[11] Patent Number: 5,403,104

[45] Date of Patent: Apr. 4, 1995

[54] DATA ENTRY GUIDE

[76] Inventor: Margo Cappellina, 5403 - 35th Ave., Kenosha, Wis. 53144

[21] Appl. No.: 212,211

[22] Filed: Mar. 14, 1994

[51] Int. Cl.[6] ..... B41J 29/18

[52] U.S. Cl. ..... 400/706; 400/709.1

[58] Field of Search ..... 400/706, 706.1, 709.1, 400/709.2, 718.1, 718.2, 718

[56] References Cited

U.S. PATENT DOCUMENTS

| | | | |
|---|---|---|---|
| 399,768 | 3/1889 | Mehrer | 116/235 |
| 1,064,475 | 6/1913 | HArton | 400/706 |
| 1,627,110 | 8/1926 | Norris | 400/706 |
| 3,179,227 | 4/1965 | Brown | 400/709.1 |
| 4,934,853 | 6/1990 | King | 400/718 |
| 5,052,650 | 10/1991 | Beile et al. | 400/718 |

OTHER PUBLICATIONS

Fellowes Workstation Copyholders Catalog Sheet-1 page.

Craft, "Paper Insertion Realignment Mechanism" IBM Technical Disclosure Bulletin, vol. 11, No. 4 Sep. 1968, p. 390.

*Primary Examiner*—Edgar S. Burr
*Assistant Examiner*—Anthony H. Nguyen
*Attorney, Agent, or Firm*—Jansson & Shupe, Ltd.

[57] ABSTRACT

Disclosed is a linear paper-grasping guide for entering data. Such guide includes a generally planar guide body having a paper contact surface and a retention tongue displaced from the body and also having a retention surface. The surfaces are substantially coplanar so that the guide securely grasps and is positionally retained on a paper sheet interposed between the body and the tongue. The new guide may have any of several other features including a bevelled edge for permitting angled viewing of text, an edge with a computer function template therealong, a colored edge directing the eye of the user to the line of text to be entered, a translucent strip to help discern the next line of text to be entered and/or indicia for setting up vertical columns.

11 Claims, 3 Drawing Sheets

DATA ENTRY GUIDE

FIELD OF THE INVENTION

This invention relates generally to office equipment and, more particularly, to equipment used for expeditious entry of printed records into, e.g., a computer system.

BACKGROUND OF THE INVENTION

It is axiomatic that organizations create many kinds of printed documents, e.g, textual matter, time records, income statement and balance sheet data, manufacturing cost records and the like, as a normal and necessary part of their activity. Usually, the information contained on such documents is arranged in multiple rows and, frequently, in columns as well. It is not uncommon to require that such information be transferred to a computer system for use in another way.

A typical way to effect such transfer is for a human operator to manually "keypunch" the data from the printed page into the computer system. This task is visually taxing at least because such operator must look alternately (and rapidly) at the printed page and the computer screen to continually verify the accuracy of that which has been entered in such system.

Earlier aids for making this task at least a little easier include an upstanding panel (often made of sheet metal) with a metal clip-like device having a shape not unlike a bobby pin. Such device both holds a sheet of paper on the panel and acts as a visual guide. In regard to the latter, the device has a straight edge placed directly beneath the line of data to be entered. Such device is devoid of any kind of indicia for creating columns.

This arrangement for entering data is attended by some problems. One is that the clip-like device is notorious for losing its "springiness" and slipping from the location at which it is last placed. Errors in data entry are more likely to occur since the user is accustomed to entering that line of data directly above the device upper edge. If the device slips, the user sometimes guesses at the line of data then under consideration—and is wrong. At least, a conscientious data entry person must stop entry and re-position the device.

Yet another problem with the aforementioned arrangement involves the fact that in certain configurations, the device is opaque. It is not possible to visually "pick up" the next line of data to be entered so that when the preceding line of data has been entered, the device can be accurately and quickly indexed to the next line. And, of course, such upstanding panels and clip-like devices are wholly unsuited for entering data from a thick stack of bound-together papers.

However, other types of guides are available. Fellowes Company has available a transparent line guide. Such guide is offered for use with its Workstation copyholders.

Another arrangement (and until the advent of the invention, about the only possible arrangement) for entering text data from such a thick stack is to simply use a common 12 inch ruler and place it beneath the line of data to be entered. This, too, has proven problematic.

Since such a rule has quite a bit of "stickout" beyond the edges of a standard 8.5 inch wide sheet of paper, it is easy to inadvertently strike a protruding ruler end and disturb the ruler position. In that event, the user must stop work and re-position the ruler before continuing.

Still another problem with known prior art arrangements relates to the fact that data is commonly entered into a computer system using a typewriter-like keyboard. Such a keyboard is immensely more complex than that of a typewriter at least in that the computer keyboard has certain keys and combinations of keys which can be depressed to change the computer "function."

For example, a common computer keyboard has twelve "F keys" (keys labeled e.g., "F1," "F2" and so forth) which, alone or with other keys, can be depressed to obtain a particular function. As an example, to center a short line of text, the "Shift" and "F6" keys are depressed simultaneously. Commonly, about 40 separate functions are available and since most computer users have not entirely memorized such functions, their use is aided by a function template placed at the top of the keyboard for easy visual reference.

Insofar as is known, earlier workers in the field of office equipment have failed to recognize that data entry from the printed page to a computer system involves not two but three "areas" which must be looked at by the data entry person. Such areas include the sheet on which the data is printed, the computer screen and, frequently, the keyboard function template. Such eye movement is conducive to entry error.

A data entry guide which addresses and resolves some of the problems and shortcomings of prior art devices would be an important advance in the art. As used in this specification, the term "data" is broadly interpreted to include both data and word text. While the inventive guide is particularly useful when entering what is commonly referred to as data, it is very helpful when entering word text as well.

OBJECTS OF THE INVENTION

It is an object of the invention to provide an improved data entry guide overcoming some of the problems and shortcomings of the prior art.

Another object of the invention is to provide an improved data entry guide having features helping to secure the guide at a selected position with respect a line of data on a sheet of paper.

Another object of the invention is to provide an improved data entry guide which permits easy viewing of data from an angle.

Still another object of the invention is to provide an improved data entry guide which "leads" the user's eye back to the proper location on a sheet of paper from which data is being entered.

Another object of the invention is to provide an improved data entry guide having indicia useful for creating columns on a sheet of paper.

Yet another object of the invention is to provide an improved data entry guide which minimizes eye movement when using a computer keyboard and function template to enter data.

Another object of the invention is to provide an improved data entry guide which aids visual "pickup" of a next line of data to be entered. How these and other objects are accomplished will become apparent from the following detailed description and from the drawing.

SUMMARY OF THE INVENTION

The invention is a linear guide for entering data. Such guide includes a generally planar guide body having an "underside" or paper contact surface. Such guide also has a retention tongue slightly offset from the body and having an "upper side" retention surface. A sheet of paper is contacted by both surfaces when the guide is in place on the sheet and the sheet is between the surfaces.

In a first preferred embodiment, the surfaces are substantially coplanar (i.e., aligned rather than spaced) so that the guide more securely "grasps" one or a few sheets of paper interposed between the body and the tongue. However, slightly spaced surfaces are appropriate if the guide is always to be used with a stack of papers, the thickness of which is at least slightly greater than the space between surfaces. Such dimensional relationship(s) greatly aid retention of the guide at a specific selected location relative to a line of data. In a highly preferred embodiment, the body includes a pair of coextensive body members defining the boundary of an opening and the tongue is in registry with the opening.

In a second, slightly different embodiment, the tongue is offset from the body but not to the degree of that embodiment described above. The body has a pair of edge surfaces along the opening and the retention tongue also has a pair edge surfaces. Each of the edge surfaces of the tongue overlaps an edge surface of the body. The first embodiment of the guide is ideal when a number of sheets of paper are held by the body and tongue. The second embodiment provides a more secure "grasp" when the guide is used with but one or two sheets of paper.

In addition to the cooperative body and tongue which, per se, coact to grasp one or more sheets of paper, the guide has other features which help retain the guide at a position selected by its user. For example, the paper contact surface on the underside of the body and the retention surface on the top of the retention tongue each have a surface area. In a preferred embodiment, such areas—which comprise the paper/guide frictional surfaces—are substantially equal to one another.

Another feature of the new guide is helpful in setting up vertical columns. The guide has a first or (to the user) upper edge which has spaced indicia marked along it for that purpose. Such indicia may be dimensionally-based, e.g., inches or centimeters, or they may be spaced according to some standard column width.

Usually, the guide and the paper from which data is being entered are placed on a flat desk top rather than being supported generally upright. In the former situation, the line of sight between the guide user's eye and the sheet is angled. If the guide has significant thickness, the line of data desired to be entered may be blocked from view. Accordingly, a preferred guide has a first or upper edge which is bevelled so that data adjacent to such edge (that data which is to be entered next) may be viewed from an angle.

In another aspect of the invention, the guide has a feature which "invites" the user's vision from, say, a computer screen back to the data being entered. Specifically, the upper edge of the guide is colored to direct vision back to such text. Appropriate colors include (among others) red, yellow and green, all of which contrast well with white paper and black print.

Another feature of the guide helps reduce the number of eye movements when the guide and a computer are being used simultaneously, as is often the case. The guide has a first edge for placement adjacent to a line of data to be entered. Such guide also has a second edge spaced from the first edge. The second edge includes a computer function key template therealong so that the guide user need not glance at the conventional functional key template typically placed on the computer keyboard above the keys.

It is often helpful to the guide user to be able to anticipate (both as to location and general makeup) the line of data immediately following that being entered. A highly preferred guide is transparent and has a contrasting translucent strip adjacent to its upper edge. The translucent strip is substantially in registry with the second line of text, i.e., with that line immediately following the line being entered.

DETAILED DESCRIPTION OF PREFERRED EMBODIMENTS

Figure 1:
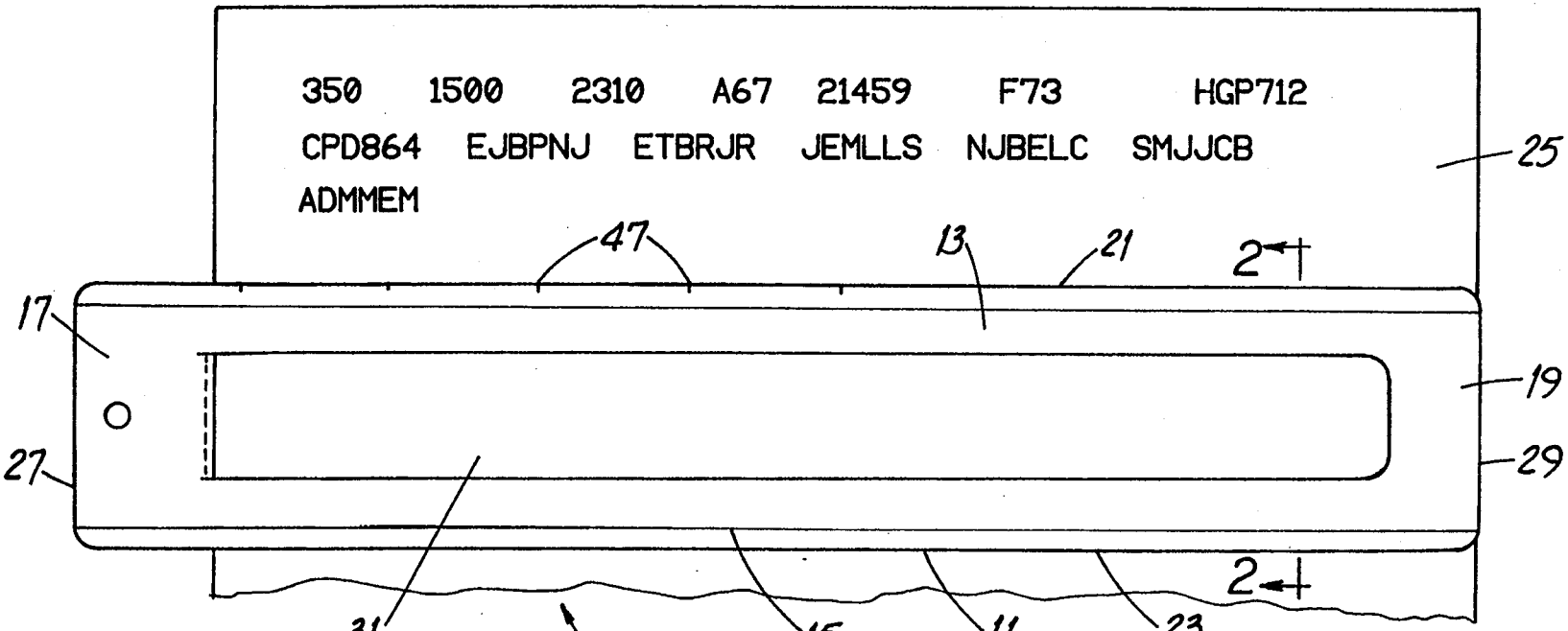
FIG. 1 is a top plan view of an embodiment of the inventive guide.
Figure 2:
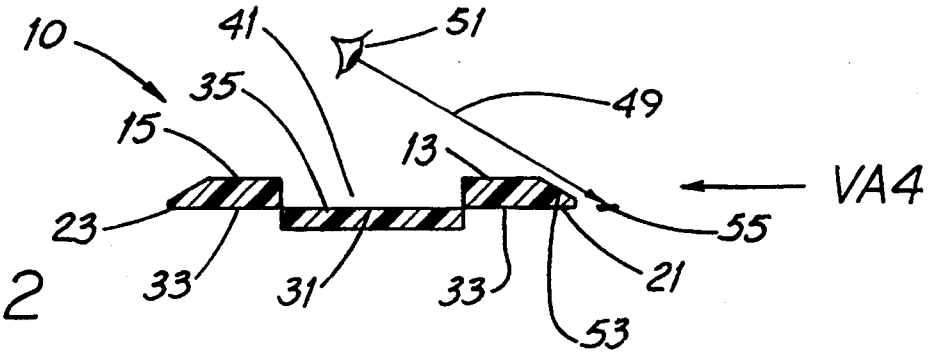
FIG. 2 is a cross-sectional end elevation view of the guide of FIG. 1 taken along the viewing plane 2—2 thereof and enlarged.

Referring to FIGS. 1 and 2, the new data entry guide 10 has a generally planar body 11 of substantially uniform thickness. For reasons that will become apparent, such body 11 is preferably made of transparent plastic although neither transparency nor plastic material are a requirement to enjoy many of the benefits of the new guide 10.

The body 11 has a pair of coextensive, generally parallel body members 13, 15 joined by connecting end portions 17, 19 and having first and second edges 21 and 23, respectively. Such edges 21, 23 are spaced from and generally parallel to one another. When intended for use primarily with sheets of paper 8½ inches wide (like sheet 25), the overall length of the guide 10 between the ends 27, 29 is preferably about 9½ inches and one end portion 17 serves as a convenient handle. Of course, the physical dimensions of such guide 10 may be selected in view of paper having a different width.

The guide 10 also has a retention tongue 31 which is slightly offset from the body 11. As shown in FIG. 2, the body 11 has an underside or paper contact surface 33. The retention tongue 31 has a upper retention surface 35 and in the illustrated embodiment, the surfaces 33, 35 are substantially coplanar, i.e., aligned with one another.

Figure 3A:
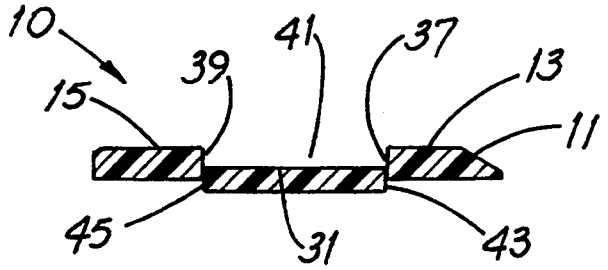
FIG. 3A is an enlarged cross-sectional end elevation view like that of FIG. 2 and showing a somewhat different embodiment of the guide.
Figure 3B:
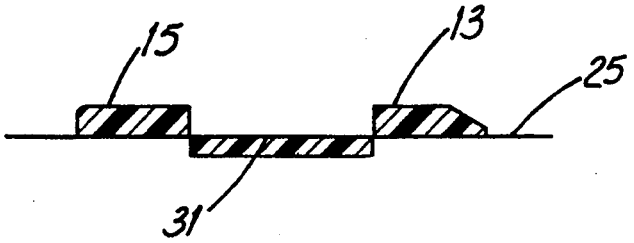
FIG. 3B is the cross-sectional end elevation view of FIG. 3A in conjunction with a sheet of paper with which the guide is used.

Referring to FIG. 3A, the tongue 31 is offset from the body members 13, 15 but not to the degree of the embodiment of FIG. 2. The body 11 has a pair of edge surfaces 37, 39 along the opening 41 and the retention tongue 31 also has a pair edge surfaces 43, 45. Each of the edge surfaces of the tongue 43, 45 overlaps an edge surface 37, 39, respectively, of the body members 13, 15. Because of the body-tongue overlap, such arrangement provides a more secure "grasp" when the body 11 and tongue 31 are spread only slightly as when the guide 10 is used with but one or two sheets of paper. This arrangement of the guide 10 in conjunction with a single sheet of paper 25 is shown in FIG. 3B. The difference in the position of the tongue 31 relative to the body 11 is to be noted when comparing FIGS. 3A and 3B.

Referring further to FIGS. 2, 3A and 3B, the paper contact surface 33 on the underside of the body has a surface area. Similarly, the retention surface 35 on the top of the retention tongue 31 also has a surface area. In a preferred embodiment, those two areas (in square inches, square centimeters or the like) are substantially equal to one another. It is believed that best guide retention occurs under circumstances where neither paper contact area is dramatically different from the other.

Another feature of the new guide 10 is helpful in setting up vertical columns. As shown in FIG. 1, the guide 10 has a first or (to the user) upper edge 21 which has spaced indicia 47 marked along it for that purpose. Such indicia 47 may be dimensionally-based, e.g., inches or centimeters, or they may be spaced according to some standard column width.

As mentioned in the Summary, it is common for the guide 10 and the paper 25 from which data is being entered to be placed on a flat desk or table top. So positioned, as shown in FIG. 2, the line of sight 49 between the guide user's eye 51 and the sheet 25 is angled. If the guide 10 has significant thickness (and that may be desirable from a rigidity and secure "paper-grasping" standpoint), the line of data desired to be entered may be blocked from view. If the guide has sufficient thickness to block data from view, the upper edge 21 of the guide 10 preferably has a bevelled face 53 so that data adjacent to such edge 21 (that data which is to be entered next, as represented by the symbol 55) may be viewed from an angle.

Figure 4:
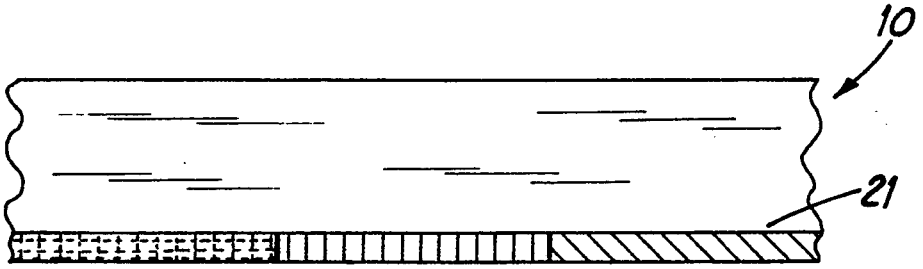
FIG. 4 is a greatly enlarged elevation view of an edge of the guide of FIG. 2 taken along viewing axis VA2 of FIG. 2. Parts are broken away.

Referring next to FIG. 4, in another aspect of the invention, a preferred guide 10 has a feature which "invites" the user's vision from, say, a computer screen back to the data being entered. Specifically, the upper edge 21 of the guide 10 is colored to direct vision back to such data. Appropriate colors include (among possible others) red, yellow and green, all of which contrast well with white paper and black print.

Figure 5:
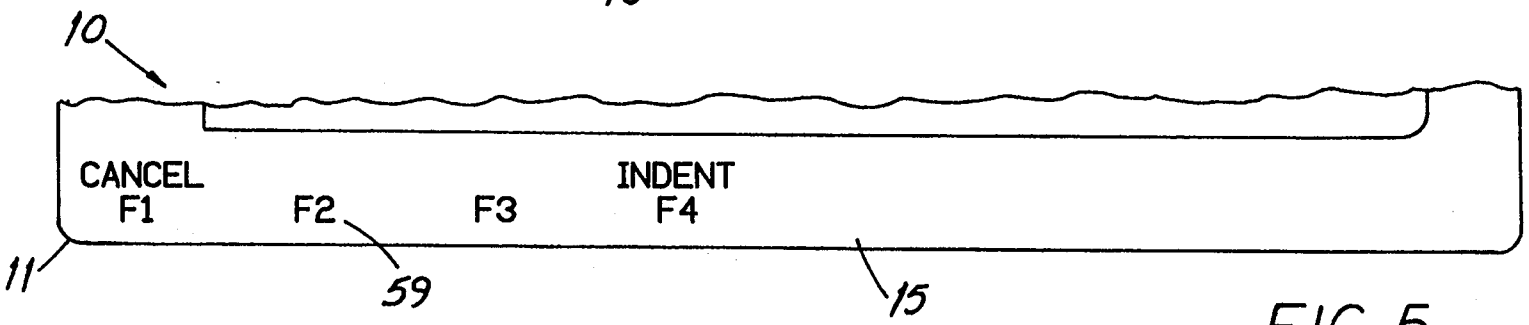
FIG. 5 is a top plan view generally like that of FIG. 1 and showing the guide with an integral function key template. Parts are broken away.
Figure 6:
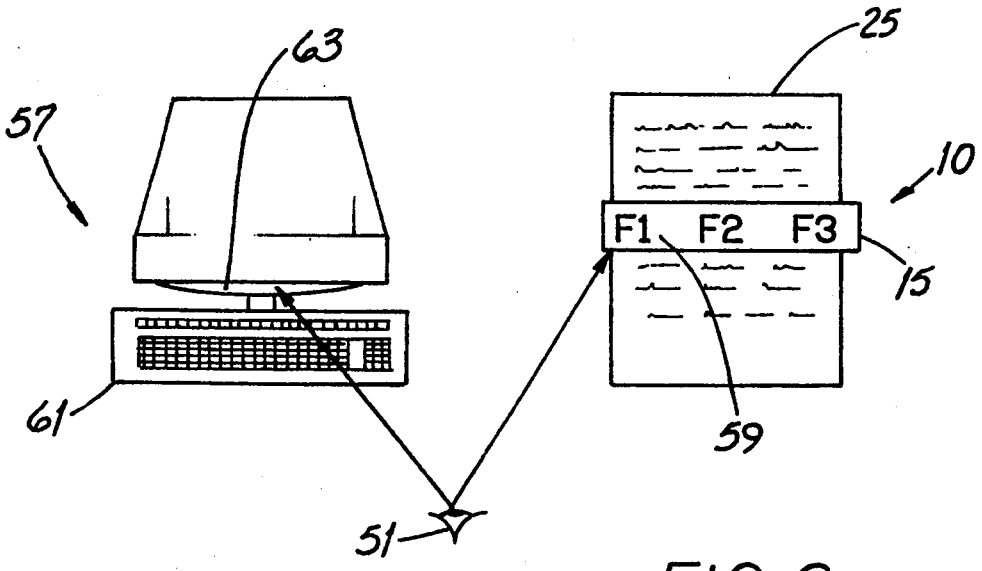
FIG. 6 is a top plan view of a portion of a representative guide having a function key template. The guide is shown in conjunction with sheet of paper and a personal computer.

Referring next to FIGS. 5 and 6, another feature of the guide 10 helps reduce the number of eye movements when the guide 10 and a computer 57 are being used simultaneously. In the illustrated embodiment, the body member 15 includes a computer function key template 59 arranged along it. Thus, the guide user need not glance at the conventional functional key template typically placed on the computer keyboard 61 above the keys—such template 59 is available on the guide 10 for easy view substantially simultaneously with data entry. That means the eye 51 of the guide user need only look between the guide 10 and the computer screen 63.

Figure 7:
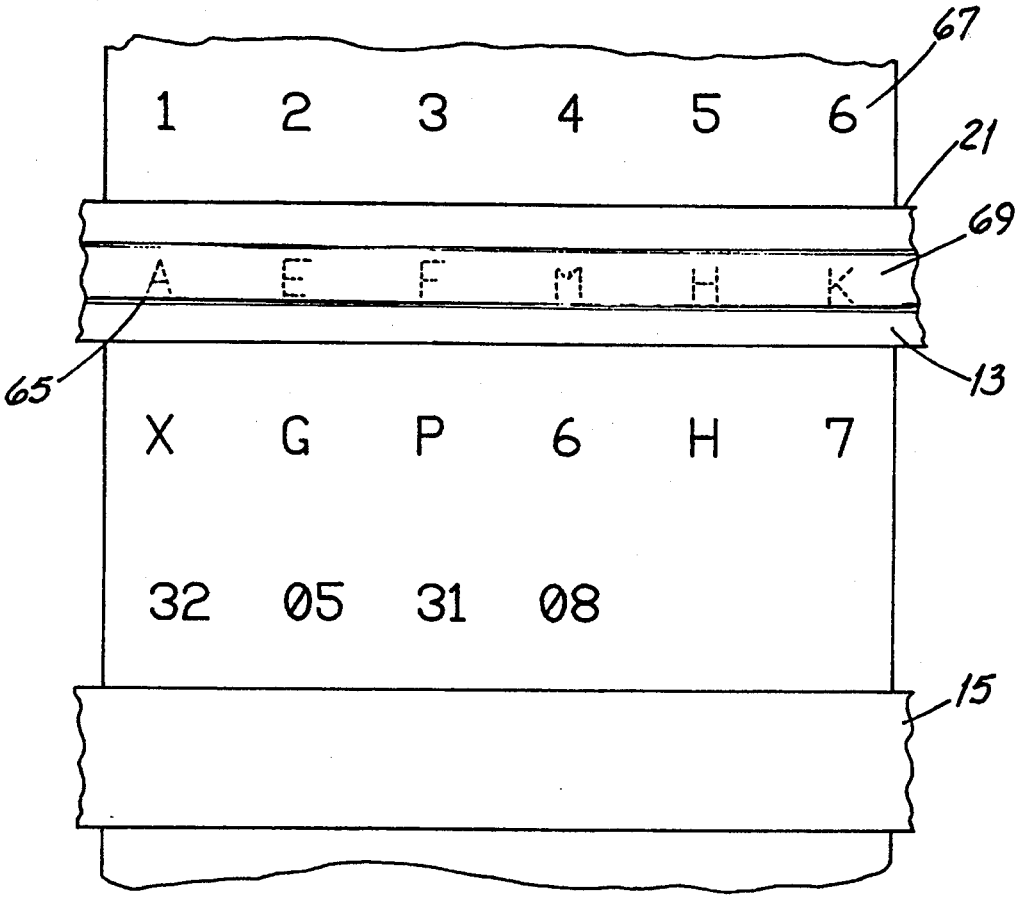
FIG. 7 is a top plan view of an embodiment of the guide having a translucent strip. The guide is shown in conjunction with a sheet of paper and parts are broken away.

Referring again to FIG. 1 and also to FIG. 7, it is often helpful to the user of the guide 10 to be able to anticipate and at least discern the line of data 65 immediately following that line 67 being entered. A highly preferred guide 10 is transparent and has a contrasting translucent strip 69 adjacent to its upper edge 21. The translucent strip 69 is substantially in registry with the second line 65 of data, i.e., with that line 65 immediately following the line 67 being entered.

While the principles of the invention have been shown and described in connection with only a few specific embodiments, it is to be understood clearly that such embodiments are by way of example and are not limiting. For example, the guide 10 is described as having an "upper" edge 21. Such edge 21 is the upper edge, irrespective of whether that end 27 having the larger end portion 17 is to the left as shown in FIG. 1 or is to the right. This may be entirely suitable for a right-handed person; a left-handed person may have the larger end portion 17 to the right when the guide 10 is in use.

And the descriptions assume the guide 10 will be used in a way that such guide 10 is positioned immediately below the line of data 67 to be entered. However, some users may wish to position the guide 10 immediately above such line of data 67. In that event (and depending upon whether the user is left- or right-handed and upon whether such user habitually lays papers to the left or the right of the computer 57), the bevelled face 53, the colored edge 21 or the like may be on the lower edge 23. These and other variations are contemplated by the invention.

It is also to be appreciated that the guide 10 need not have each and every feature described above. For example, a guide 10 devoid of indicia 47, of a function key template 59, of a translucent strip 69 and having only a colored edge 21 would nevertheless be very useful for data entry.

What is claimed:

1. A linear guide for entering data said guide being adapted to mounted on a page, said linear guide including:

a generally planar guide body having an opening therethrough, said body circumscribing the opening;

a retention tongue offset from the body when the linear guide is not mounted on a page: and wherein:

the body has a pair of edge surfaces along the opening;

the retention tongue has a pair of edge surfaces; and each of the edge surfaces of the tongue only partially overlaps said edge surfaces of the body when the linear guide is not mounted on a page, said retention tongue being deflectable so that said edge surfaces of said retention tongue do not overlap said edge surfaces of said body to permit said linear guide to be mounted on a page, whereby the guide is positionally retained on a paper sheet interposed between the body and the tongue.

2. The guide of claim 1 including a first edge and wherein:

the first edge is bevelled, whereby data adjacent thereto may be viewed from an angle.

3. The guide of claim 1 including a first edge and wherein:

the first edge is colored to direct vision to data adjacent to the first edge.

4. The guide of claim 1 wherein:

the body includes a pair of coextensive body members defining the boundary of said opening.

5. The guide of claim 4 wherein:

the retention tongue has a first surface area;

the body has a second surface area; and the areas are substantially equal to one another.

6. The guide of claim 1 wherein:

the guide has spaced-apart indicia marked along substantially the entire length of one of the edge surfaces of the body for setting up vertical columns.

7. The guide of claim 1 including a first edge and wherein:

the first edge is bevelled along substantially the entire length of said first edge, whereby data adjacent thereto may be viewed from an angle.

8. The guide of claim 1 including a first edge and wherein:

the first edge is colored to direct vision to data adjacent to the first edge.

9. The guide of claim 8 wherein the first edge is bevelled so that data adjacent thereto may be viewed from an angle.

10. The guide of claim 1 including (a) a first edge for placement adjacent to text to be entered and (b) a second edge spaced from the first edge and wherein:

the second edge includes a computer function key template therealong, whereby simultaneous guide and computer use is visually aided.

11. The guide of claim 1 including a first edge for placement adjacent to a line of data to be entered and wherein:

the guide body is transparent;

the guide has a contrasting translucent strip adjacent to the first edge; and the translucent strip is substantially in registry with a second line of data immediately following the line of data to be entered, whereby the guide user may visually discern the second line of data.

* * * * *